US009957123B2

(12) United States Patent
Uohashi et al.

(10) Patent No.: US 9,957,123 B2
(45) Date of Patent: May 1, 2018

(54) SHEET FEEDING DEVICE AND IMAGE FORMING APPARATUS

(71) Applicant: KYOCERA Document Solutions Inc., Osaka (JP)

(72) Inventors: Yuki Uohashi, Osaka (JP); Daisuke Fujiwara, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days. days.

(21) Appl. No.: 15/393,987

(22) Filed: Dec. 29, 2016

(65) Prior Publication Data

US 2017/0190528 A1 Jul. 6, 2017

(30) Foreign Application Priority Data

Jan. 6, 2016 (JP) ..... 2016-001122

(51) Int. Cl.
*B65H 1/08* (2006.01)
*B65H 3/06* (2006.01)
*G03G 15/00* (2006.01)

(52) U.S. Cl.
CPC ..... *B65H 3/0661* (2013.01); *G03G 15/6529* (2013.01); *B65H 3/0669* (2013.01); *B65H 2402/441* (2013.01); *B65H 2402/52211* (2013.01); *B65H 2601/324* (2013.01)

(58) Field of Classification Search
CPC ..... B65H 3/0669; B65H 3/0676; B65H 2402/441; B65H 2402/521; B65H 2402/522; B65H 2402/5221; B65H 2402/52211; B65H 2601/324
See application file for complete search history.

(56) References Cited

U.S. PATENT DOCUMENTS 5,421,569 A * 6/1995 Davidson ..... B65H 3/0669 271/109
5,769,410 A * 6/1998 Davidson ..... B65H 3/0669 271/109
2013/0256971 A1* 10/2013 Ueyama ..... B65H 5/06 271/4.1

FOREIGN PATENT DOCUMENTS

JP 2001-294335 A 10/2001

* cited by examiner

*Primary Examiner* — Howard J Sanders
(74) *Attorney, Agent, or Firm* — Studebaker & Brackett PC

(57) ABSTRACT

A sheet feeding device includes a pickup roller, a feed roller, a feed holder and a mounting part. The pickup roller rotates around a first rotating shaft and then to feed a sheet. The feed holder supports the first rotating shaft. To the mounting part, the feed holder is mounted and dismounted. The mounting part has a pair of guide grooves. The feed holder has a pair of guide shafts protruding in a direction parallel to the first rotating shaft. The pair of guide shafts are guided along the pair of guide grooves. The pair of guide shafts are formed on an axis line different from an axis line of the first rotating shaft.

9 Claims, 15 Drawing Sheets

SHEET FEEDING DEVICE AND IMAGE FORMING APPARATUS

INCORPORATION BY REFERENCE

This application is based on and claims the benefit of priority from Japanese Patent application No. 2016-001122 filed on Jan. 6, 2016, which is incorporated by reference in its entirety.

BACKGROUND

The present disclosure relates to a sheet feeding device configured to feed a sheet and an image forming apparatus including the sheet feeding device.

In an image forming apparatus such as a copying machine or a printer, a sheet is fed from a sheet feeding cassette by a sheet feeding device to an image forming part. The sheet feeding device is provided with a pickup roller, a feed roller and a retard roller. The pickup roller feeds the sheet from the sheet feeding cassette. The feed roller conveys the fed sheet to the image forming part. The retard roller conveys the sheet one by one without double feeding.

These rollers come into contact with the sheet and thus are worn away by friction with the sheet in a long time use. Alternatively, paper powder is easily adhered on these rollers depending on a type of sheet. This deteriorates a conveying force of the sheet and thus a feeding failure is likely to occur. Accordingly, it is preferable for these rollers to be easily replaced and repaired.

Then, there is a sheet feeding device in which a feed holder which supports the pickup roller and the feed roller is attachable to and detachable from an apparatus main body while the retard roller is disposed on the apparatus main body. When the feed holder is mounted to the apparatus main body, the feed roller is coupled to a driving shaft disposed on the apparatus main body. The feed roller is driven by the rotating force of the driving shaft to be rotated and the pickup roller is also rotated by the rotating force transmitted from the feed roller. The sheet feeding device makes it easy to replace the rollers by dismounting the feed holder from the apparatus main body.

In addition, in order to position the feed holder to the apparatus main body, a guide shaft protruding on the same axis of the pickup roller is formed on the feed holder while a guide groove with which the guide shaft is engaged and guided into a predetermined feeding position is formed on the apparatus main body.

As described above, in a case where the guide shaft protruding on the same axis of the pickup roller is formed on the feed holder, because a protrusion length of the guide shaft is long, some problems may occur. For example, a dye used for molding the feed holder requires a deep cavity. Alternatively, a degree of freedom in design of the dye becomes low.

In addition, when the image forming apparatus may have a rear face C-path route formed along a rear face of the apparatus main body in a substantial C-shape, the feed holder is mounted and dismounted from the rear side of the apparatus main body. Furthermore, in some image forming apparatuses, a manual bypass path may be formed from a front side of the apparatus main body toward the rear side above the sheet feeding cassette. The manual bypass path is joined to a main conveying path on a downstream side of the sheet feeding device, In the image forming apparatus having the above conveying paths, when the feed holder is mounted from the rear side of the apparatus main body, if the guide shaft protrudes on the same axis on the pickup roller, it is necessary to engage the guide shaft with the guide groove while avoiding the driving shaft of the feed roller. This complicates the mounting work. In addition, it is necessary to keep a passing space through which an upper portion above the guide shaft of the feed roller is passed. When a reduction in size of the image forming apparatus advances, the passing space may interfere with the manual bypass path.

Alternatively, in order to position the feed holder to the apparatus main body without forming the guide shaft and the guide groove, a positioning member is required for each of the feed holder and the apparatus main body. This leads to complication in structure of the sheet feeding device and increasing in cost.

SUMMARY

In accordance with an embodiment of the present disclosure, a sheet feeding device is configured to feed a sheet stacked on a lift plate. The sheet feeding device includes a pickup roller, a feed roller, a feed holder and a mounting part. The pickup roller is configured to come in pressure contact with the sheet by moving the lift plate upward, to rotate around a first rotating shaft and then to feed the sheet. The feed roller is configured to rotate around a second rotating shaft and to convey the sheet fed by the pickup roller along a conveying path. The feed holder has a pair of side plates formed parallel to a feeding direction of the sheet. The pair of side plates supports the first rotating shaft and the second rotating shaft so as to extend in a direction perpendicular to the feeding direction. To the mounting part, the feed holder is mounted and dismounted along mounting and dismounting directions parallel to the feeding direction. The mounting part has a pair of side walls and a pair of guide grooves. The pair of side walls face each other in a direction perpendicular to the mounting and dismounting directions. The pair of guide grooves are formed on the pair of side walls along the mounting and dismounting directions. The feed roller has a pair of guide shafts. The pair of guide shafts protrudes from the pair of side plates in a direction parallel to the first rotating shaft. The pair of guide shafts are engaged with the pair of guide grooves and guided along the pair of guide grooves. The pair of guide shafts are formed on an axis line different from an axis line of the first rotating shaft.

In accordance with an embodiment of the present disclosure, an image forming apparatus includes the above sheet feeding device and an image forming part. The image forming parts forms an image on a sheet fed by the sheet feeding device.

In accordance with an embodiment of the present disclosure, an image forming apparatus includes a sheet storage part, a lift plate, a pickup roller, a feed roller, a feed holder and a mounting part. In the sheet storage part, a sheet is stored. The lift plate is provided in the sheet storage part movable upward and downward. The sheet is stacked on the lift plate. The pickup roller is configured to come in pressure contact with the sheet by moving the lift plate upward, to rotate around a first rotating shaft and then to feed the sheet. The feed roller is configured to rotate around a second rotating shaft and to convey the sheet fed by the pickup roller along a conveying path. The feed holder supports the first rotating shaft and the second rotating shaft. To the mounting part, the feed holder is mounted and dismounted along mounting and dismounting directions parallel to a feeding direction of the sheet. The feed holder has a pair of side plates, a pair of guide shafts and a pair of supporting shafts. The pair of side plates are formed parallel to the mounting and dismounting directions. The pair of side plates support the first rotating shaft and the second rotating shaft so as to extend in a direction perpendicular to the mounting and dismounting directions. The pair of guide shafts protrude from the pair of side plates along an axis line different from an axis line of the first rotating shaft. The pair of supporting shafts protrude from the pair of side plates on an upstream side of the pair of guide shafts in the mounting direction. The mounting part has a pair of side walls, a pair of guide grooves and a pair of bearing parts. The pair of side walls face each other in a direction perpendicular to the mounting and dismounting directions. The pair of guide grooves are formed on the pair of side walls along the mounting and dismounting directions so that the pair of guide shafts are engaged with and guided along the pair of guide grooves. The pair of bearing parts support the pair of supporting shafts at a predetermined position. The pair of guide shafts are formed above the first rotating shaft in a direction of a tangent line to a circle centered on the pair of supporting shafts and passing through the center of the first rotating shaft. The tangent line passed through the center of the first rotating shaft. Each of the pair of guide grooves has a contact face with which each of the pair of guide shafts comes in pressure contact when the sheet comes in pressure contact with the pickup roller by moving the lift plate upward and the pickup roller is pressed upward by the sheet. The contact face is formed along a direction perpendicular to the tangent line.

The above and other objects, features, and advantages of the present disclosure will become more apparent from the following description when taken in conjunction with the accompanying drawings in which a preferred embodiment of the present disclosure is shown by way of illustrative example.

DETAILED DESCRIPTION

Hereinafter, with reference to figures, an image forming apparatus and a sheet feeding device according to an embodiment of the present disclosure will be described.

Figure 1:
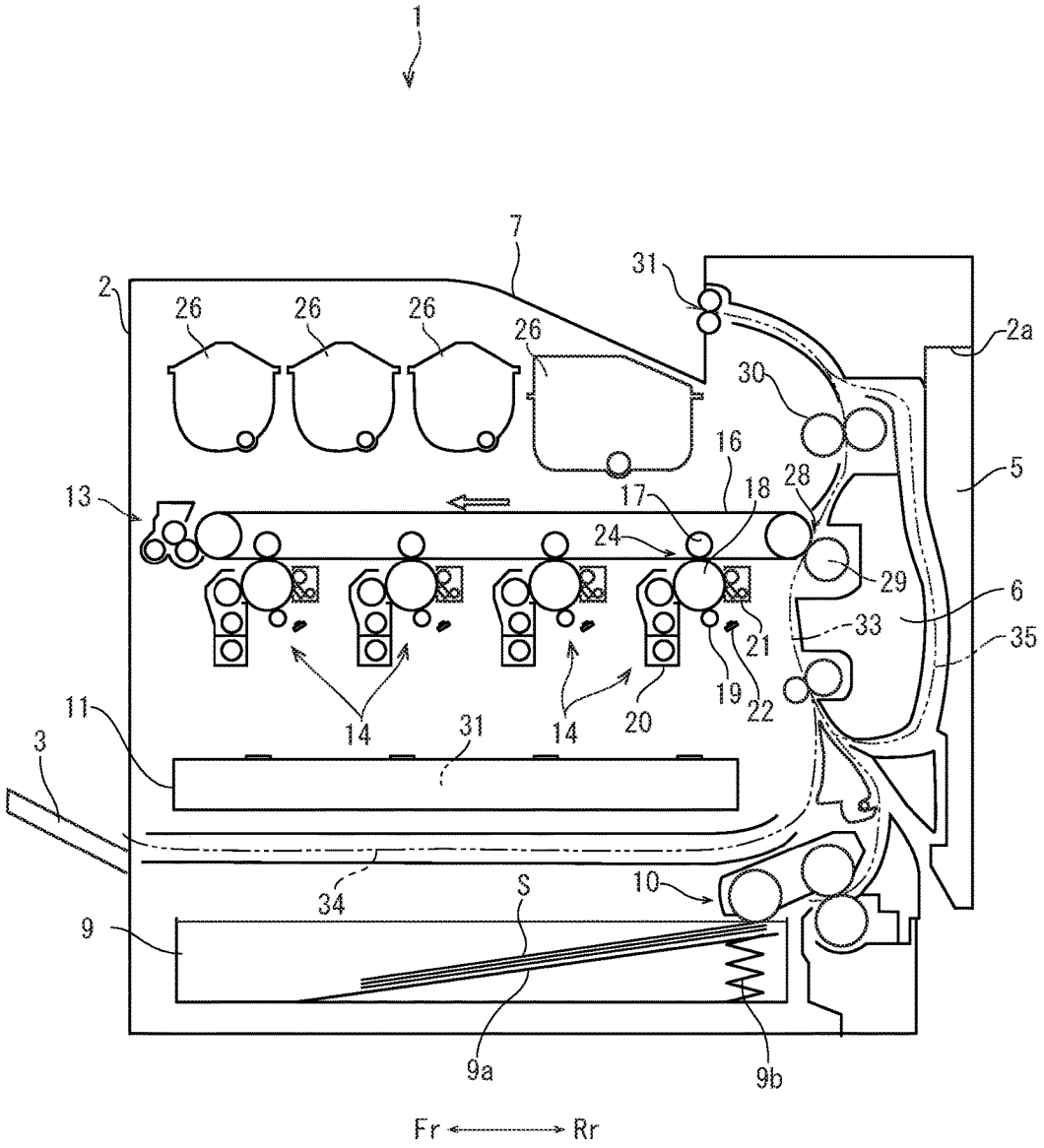
FIG. 1 is a view schematically showing an internal structure of a color printer according to an embodiment of the present disclosure.

First, with reference to FIG. 1, an entire structure of a color printer 1 as an image forming apparatus will be described. FIG. 1 is a view schematically showing an internal structure of the color printer 1. In the following description, a left side on the paper plane shows a front side of the color printer, and left and right directions are based on a direction in which the color printer is viewed from the front side. In each figure, Fr, Rr, L and R show a front side, a rear side, a left side and a right side, respectively.

The color printer 1 has a box-shaped casing 2. On a front face of the casing 2, a manual bypass tray 3 is provided. On an upper face of the casing 2, an ejected sheet tray 7 on which a sheet is ejected is formed. On a rear face of the casing 2, an opening 2*a* is formed. The opening 2*a* is opened and closed by a rear cover 5 which is supported rotatably around its lower end. Inside of the rear cover 5, a conveying unit 6 is supported rotatably around its lower end.

In a lower space of the casing 2, a sheet feeding cassette 9 is detachably attached as a sheet storage part in which the sheet S is stored. The sheet feeding cassette 9 is provided with a lift plate 9*a* on which the sheet S is placed and a spring member 9*b* which biases a rear end portion of the lift plate 9*a* upward. Above a rear end portion of the sheet feeding cassette 9, a sheet feeding device 10 configured to feed the sheet S from the sheet feeding cassette 9 is provided. The sheet feeding device 10 will be described in detail later. Above the sheet feeding cassette 9, an exposure device 11 having a laser scanning unit (LSU) is provided. Above the exposure device 11, an intermediate transferring unit 13 and four image forming units 14 corresponding to four colors (Yellow, Magenta, Cyan and Black) of toner are provided. The four image forming units 14 are arranged under the intermediate transferring unit 13.

The intermediate transferring unit 13 has an intermediate transferring belt 16 and four first transferring rollers 17. The intermediate transferring belt 16 circulates and rotates around a plurality of rollers. The four first transferring rollers 17 are disposed in a hollow space of the intermediate transferring belt 16 along the left and right directions. Each of the image forming unit 14 has a rotatable photosensitive drum 18, a charger 19, a development device 20, a cleaning device 21 and an eliminator 22. The charger 19, the development device 20, the cleaning device 21 and the eliminator 22 are disposed around the photosensitive drum 18 along a rotating direction of the photosensitive drum 18. The photosensitive drum 18 faces the first transferring roller 17 via the intermediate transferring belt 16 between the development device 20 and the cleaning device 21. Between the photosensitive drum 18 and the intermediate transferring belt 16, a first transferring part 24 is formed. Above the intermediate transferring unit 13, four toner containers 26 corresponding to the four image forming units 14 are detachably attached.

On a rear side of the intermediate transferring unit 13, a second transferring roller 27 is rotatably supported by the conveying unit 6. Between the second transferring roller and the intermediate transferring belt 16, a second transferring part 28 is formed. Above the second transferring part 28, a fixing device 29 is provided. Above the fixing device 29, a sheet ejecting device 30 is provided.

In the casing 2, a main conveying path 33, a manual bypass conveying path 34 and a duplex printing path 35 for the sheet S are formed. The main conveying path 33 is formed from the sheet feeding device 10 toward the sheet ejecting device 30 through the second transferring part 28 and the fixing device 29. The manual bypass conveying path 34 is formed from the manual bypass tray 3 through a space between the sheet feeding cassette 9 and the exposure device 11, and joined to the main conveying path 33 on a downstream side of the sheet feeding device 10. The duplex printing path 35 is branched from the main conveying path 33 on the downstream side of the fixing device 29, curved in a substantial C-shape between the rear cover 5 and the conveying unit 6 and then joined to the main conveying path 33 at a joined position with the manual bypass conveying path 34.

Next, an operation of forming an image by the color printer 1 having such a configuration will be described. In each image forming unit 14, after a surface of the photosensitive drum 18 is charged by the charger 19, the exposure device 11 exposes the surface of the photosensitive drum 18 with a laser light based on an image date to form an electrostatic latent image on the surface of the photosensitive drum 18. The electrostatic latent image is then developed into a toner image of the toner of corresponding color by the development device 20. The toner image is first transferred on a surface of the intermediate transferring belt 16 at the first transferring part 24. The above operation is performed at each image forming unit 14 to form a full color toner image on the intermediate transferring belt 16. The toner and charge remained on the photosensitive drum 18 are removed by the cleaning device 21 and the eliminator 22 respectively.

On the other hand, the sheet S fed from the sheet feeding cassette 9 by the sheet feeding device 10 is conveyed along the main conveying path 33 into the second transferring part 28 in a suitable timing with the above image forming operation. At the second transferring part 28, the full color toner image on the intermediate transferring belt 16 is second transferred on the sheet S. The sheet S on which the toner image is transferred is conveyed along the main conveying path 33 into the fixing device 29. At the fixing device 29, the toner image is fixed on the sheet. The sheet with the fixed toner image is ejected from the sheet ejecting device 30 on the ejected sheet tray 4. At a duplex printing, a sheet S formed an image on one face is conveyed from the duplex printing path 35 to the main conveying path 33 and an image is formed on the other face of the sheet S. The sheet S formed image on both faces is ejected by the sheet ejecting device 30. The sheet fed from the manual bypass tray 3 is conveyed from the manual bypass conveying path 34 to the main conveying path 33. Then, an image is formed in the same way.

Figure 2:
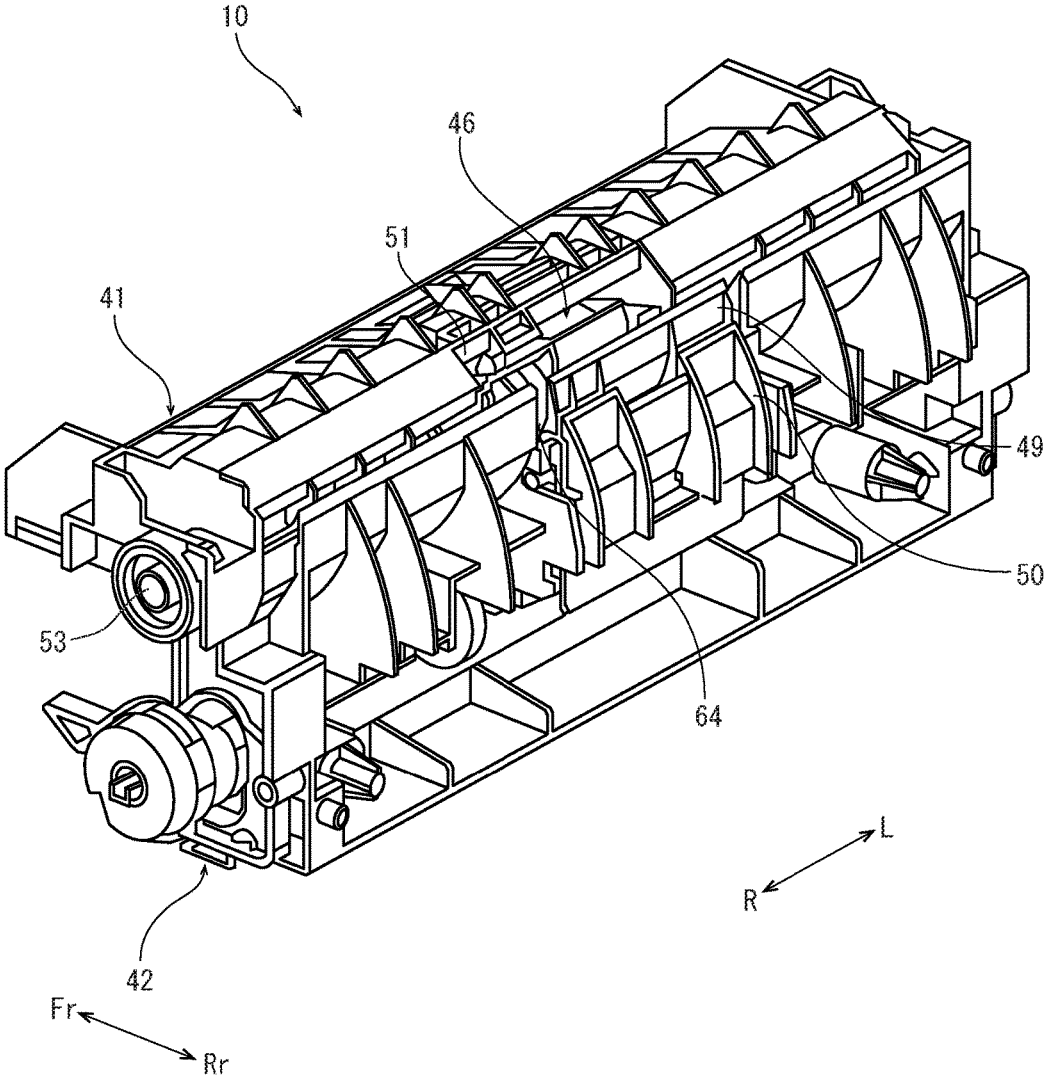
FIG. 2 is a perspective view showing a sheet feeding device according to an embodiment of the present disclosure.
Figure 3:
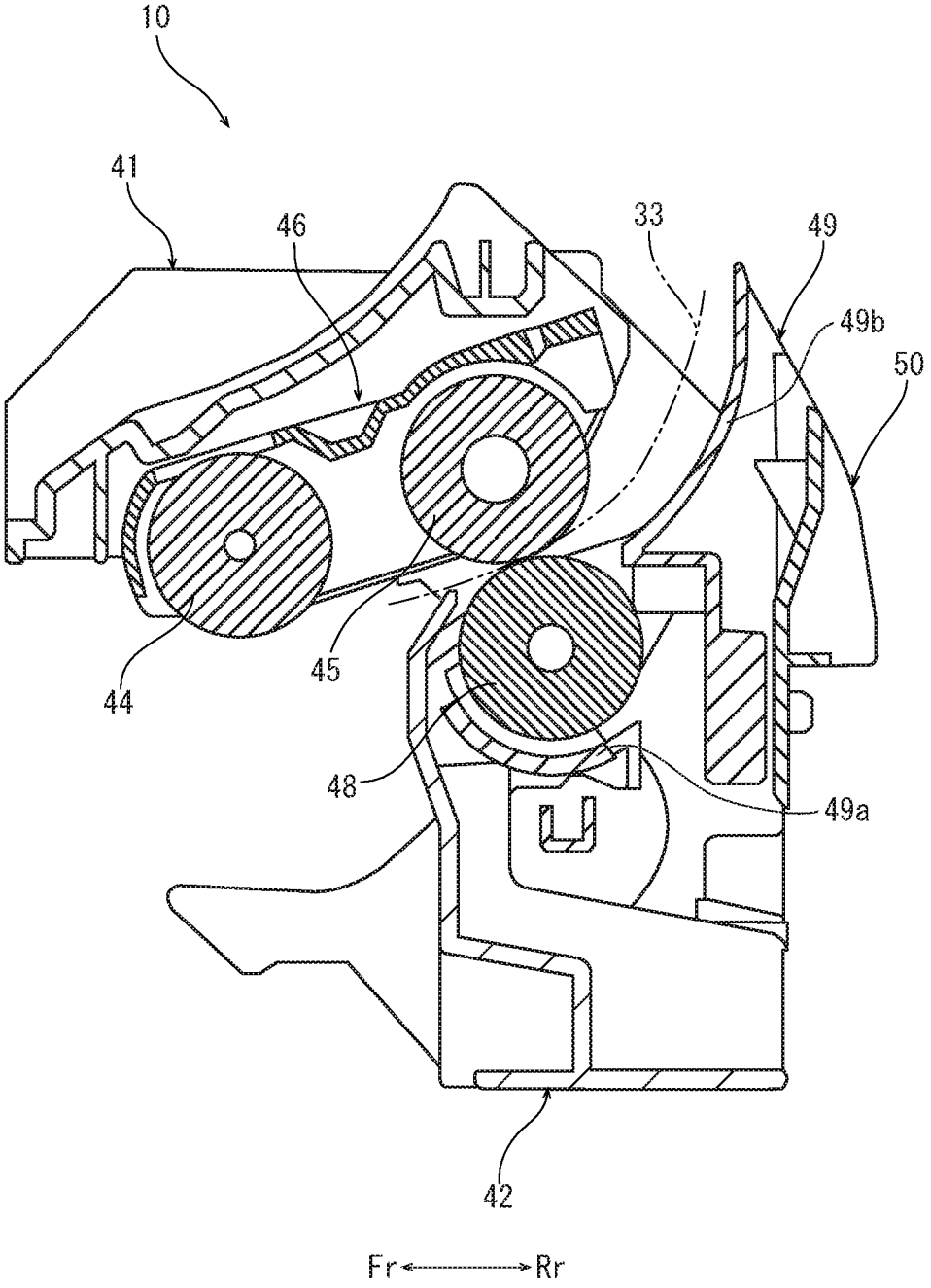
FIG. 3 is a sectional side view showing the sheet feeding device according to the embodiment of the present disclosure.

Next, with reference to FIG. 2 and FIG. 3, the sheet feeding device 10 will be described. FIG. 2 is a perspective view showing the sheet feeding device 10 and FIG. 3 is a sectional side view showing the sheet feeding device 10.

The sheet feeding device 10 is provided with an upper supporting frame 41, a lower supporting frame 42, a feed holder 46, a retard holder 49 and a stopper 50. The upper supporting frame 41 and the lower supporting frame 42 are respectively disposed on an upper side and on a lower side of the main conveying path 33 (refer to FIG. 3). The feed holder 46 is mounted and dismounted to the upper supporting frame 41 in mounting and dismounting directions parallel to a feeding direction of the sheet S. The retard holder 49 is mounted and dismounted to the lower supporting frame 42. The stopper 50 is supported to the lower supporting frame 42 and prevents the retard holder 49 from being displaced. The feed holder 46 rotatably stores a pickup roller 44 and a feed roller 45. The retard holder 49 rotatably stores a retard roller 48.

Figure 4:
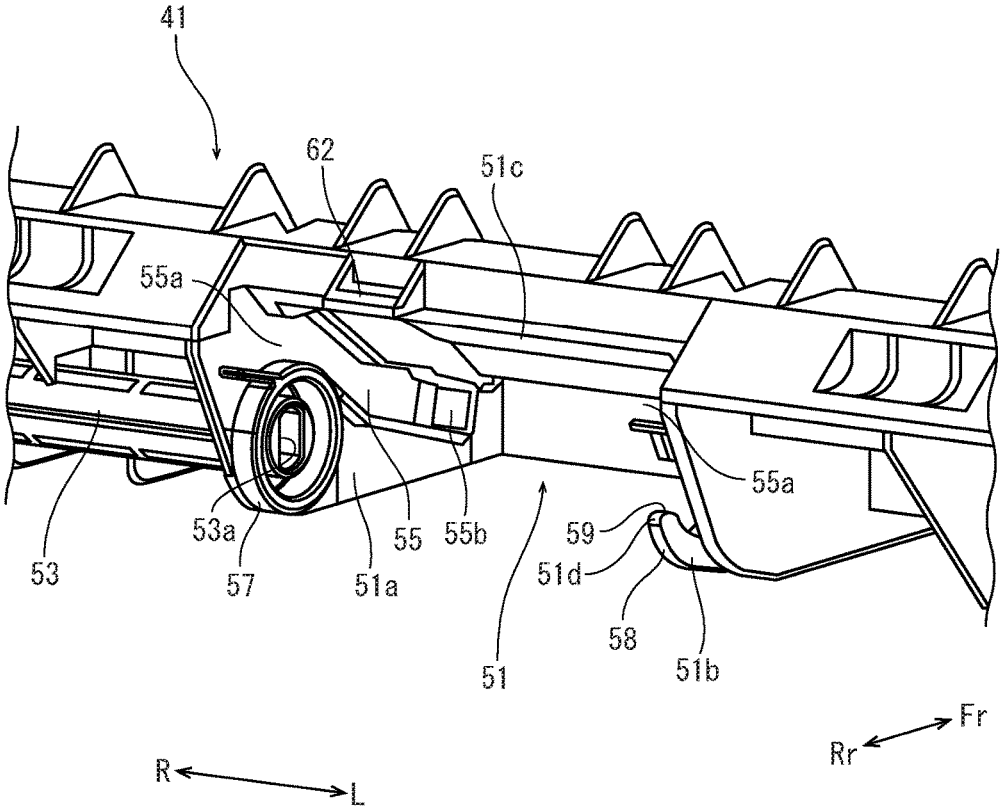
FIG. 4 is a perspective view showing a first side wall of an upper mounting part of an upper supporting frame, in the sheet feeding device according to the embodiment of the present disclosure.
Figure 5:
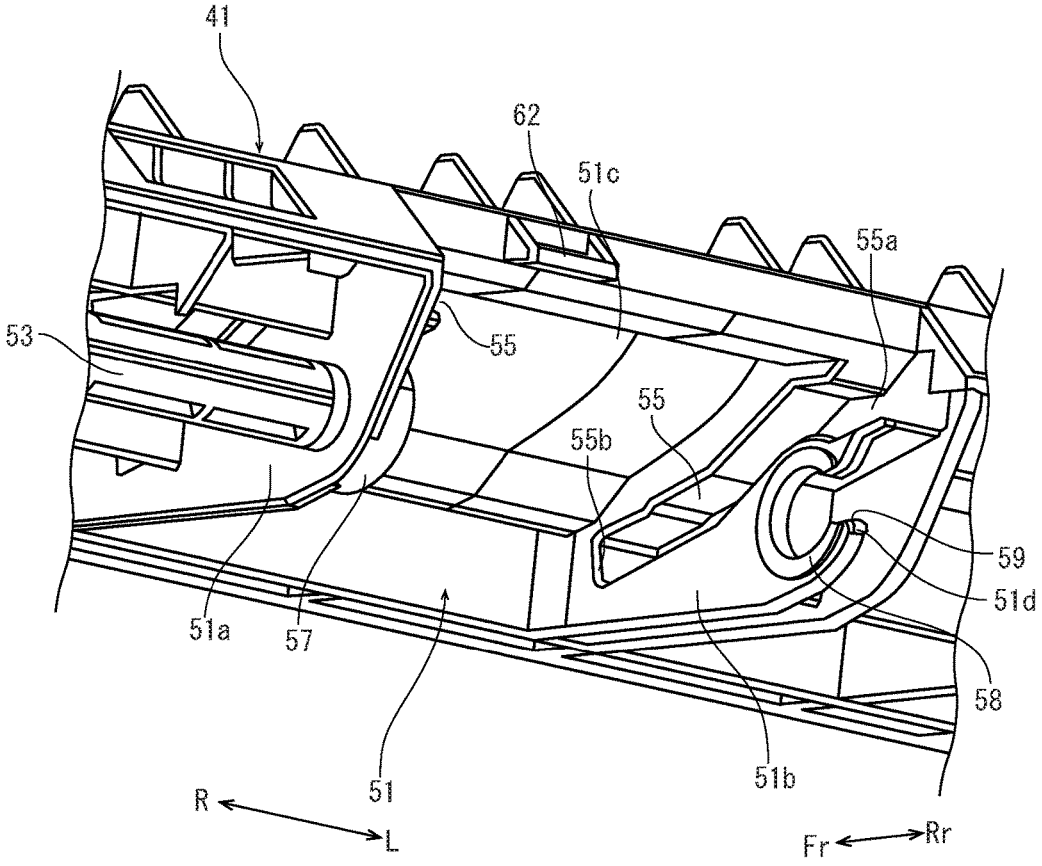
FIG. 5 is a perspective view showing a second side wall of the upper mounting part of the upper supporting frame, in the sheet feeding device according to the embodiment of the present disclosure.

With reference to FIG. 4 and FIG. 5, the upper supporting frame 41 will be described. FIG. 4 is a perspective view showing an upper mounting part viewed from the left rear side and FIG. 5 is a perspective view showing the upper mounting part viewed from the right rear side.

The upper supporting frame 41 is provided along a sheet width direction (the left and right directions) crossing the feeding direction of the sheet S. On a lower face of the upper supporting frame 41, a plurality of ribs inclined in an upper rear oblique direction are formed to form an upper guide face of the main conveying path 33. On an upper face of the upper supporting frame 41, a plurality of ribs inclined in an upper rear oblique direction are formed to form a lower guide face of the manual bypass conveying path 34.

On the lower face of the upper supporting frame 41, an upper mounting part 51 to which the feed holder 46 is mounted and dismounted is formed at a center portion in the sheet width direction. On the right side of the upper mounting part 51 in the sheet width direction, a driving shaft 53 which transmits a driving force to the feed roller 45 is rotatably supported in the upper supporting frame 41. The driving shaft 53 rotates around a rotating axis perpendicular to the mounting and dismounting directions. As shown in FIG. 4, on a tip end face of the driving shaft 53, an engagement hole 53*a* of a substantially oval cross-section is formed.

The upper mounting part 51 has a first side wall 51*a* and a second side wall 51*b* that are a pair of side walls which face each other in the direction perpendicular to the mounting and dismounting directions, a top wall 51*c* and a front wall 51*d* with a rear face (a face on an upstream side in the mounting direction) and a bottom face opened. The first side wall 51*a* is formed along the mounting and dismounting directions (the front and rear directions) on a side (one side) of the driving shaft 53 in the sheet width direction. The second side wall 51*b* is formed along the mounting and dismounting directions (the front and rear directions) on an opposite side (the other side) to the driving shaft 53 in the sheet width direction.

As shown in FIG. 4, the first side wall 51*a* has a boss-hole shaped first bearing part 57 at the rear end portion (the end portion on the upstream side in the mounting direction). Into the first bearing part 57, the tip end portion of the driving shaft 53 enters. As shown in FIG. 5, the second side wall 51*b* has a boss-hole shaped second bearing part 58 at the rear end portion (the end portion on the upstream side in the mounting direction). The first bearing part 57 and the second bearing part 58 are arranged on the same axis. On a rear edge 51*e* of the second side wall 51*b*, a notch 59 communicating with the second bearing part 58 is formed. The notch 59 has a width smaller than an internal diameter of the second bearing part 58.

Further, the first side wall 51*a* and the second side wall 51*b* each have a guide groove 55 which guides the feed holder 46. Each of the guide groove 55 extends forward (toward a downstream side in the mounting direction) from an opening end 55*a* to a closed end 55*b* in a lower oblique direction above each of the first bearing part 57 and the second bearing part 58. The feed holder 46 is slid along the guide grooves 55 forward to be mounted to the upper mounting part 51 and slid along the guide grooves 55 rearward to be dismounted from the upper mounting part 51. That is, the mounting and dismounting directions of the feed holder 46 are respectively the front and rear directions.

Figure 6:
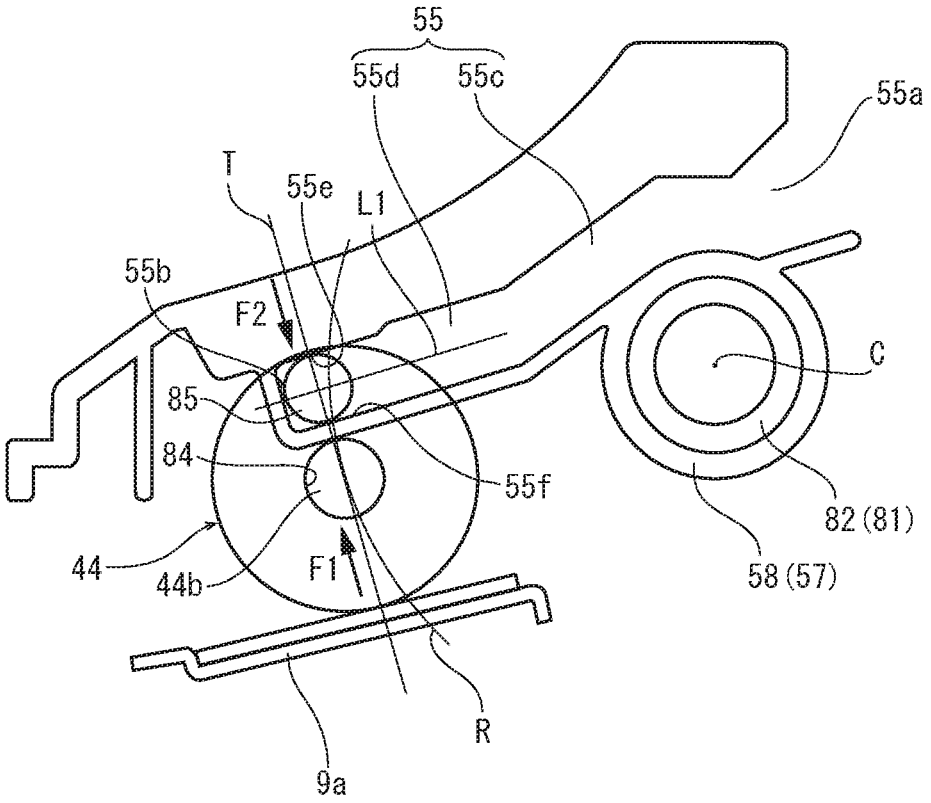
FIG. 6 is a side view showing a positional relationship of a guide groove of the upper mounting part, a pickup roller and a guide shaft, in the sheet feeding device according to the embodiment of the present disclosure.

With reference to FIG. 6, the guide groove 55 will be described. FIG. 6 is a side view showing the guide groove. The guide groove 55 has a first inclined part 55*c* and a second inclined part 55*d* in the order from the opening end 55*a*. An inclination angle of the second inclined part 55*d* relative to a horizontal plane is smaller than an inclination angle of the first inclined part 55*c* relative to the horizontal plane.

In addition, with reference to FIGS. 4 and 5, the top wall 51*c* of the upper mounting part 51 has a locking piece 62 protruding rearward from a right side portion of the rear edge.

Figure 7:
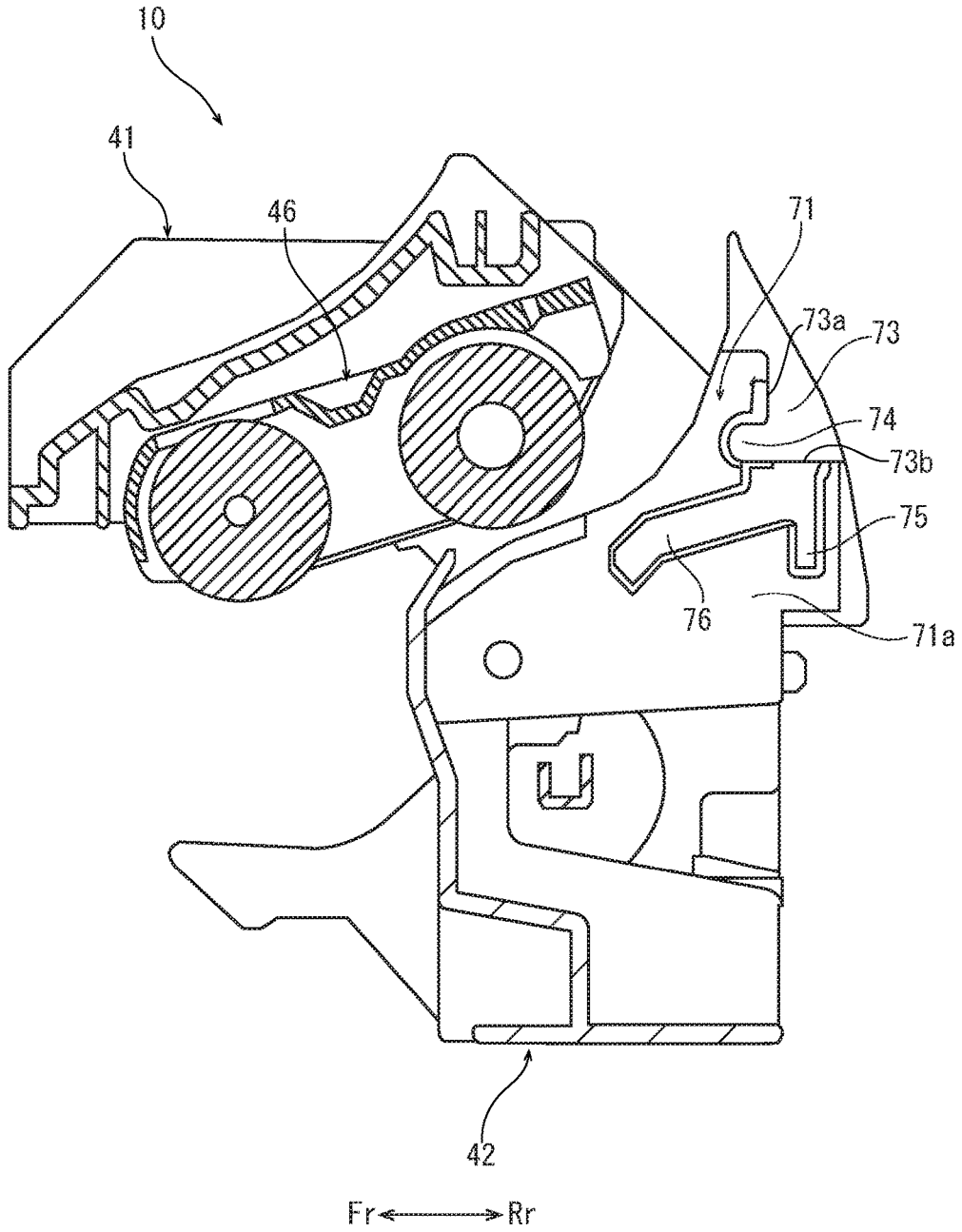
FIG. 7 is a side sectional view showing a lower mounting part of a lower supporting frame, in the sheet feeding device according to the embodiment of the present disclosure.

With reference to FIG. 3 and FIG. 7, the lower supporting frame 42 will be described. FIG. 7 is a side view showing the lower mounting part. The lower supporting frame 42 is provided along the sheet width direction. An upper face of the lower supporting frame 42 curves in an upper rear oblique direction to forma lower guide face of the main conveying path 33. On the upper face of the lower supporting frame 42, a lower mounting part 71 to which the retard holder 49 is mounted and dismounted is formed at a center portion in the sheet width direction. A rear face and an upper face of the lower mounting part 71 are opened. The lower mounting part 71 opposes on a lower right side of the upper mounting part 51.

The lower mounting part 71, as shown in FIG. 7, has a pair of side walls 71*a* which face each other in the sheet width direction. In a substantially upper halve portion of each sidewall 71*a*, a substantially right-angled triangle shaped notch 73 is formed. At a lower portion of a perpendicular edge 73*a* of the notch 73, a hemispheric engaging depression 74 is formed. Further, each of the side walls 71*a* is formed with a first groove 75 and a second groove 76. The first groove 75 extends downward straightly from a horizontal edge 73*b* of the notch 73. The second groove 76 extends in a lower front oblique direction from a front side portion from the first groove 75 of the horizontal edge 73*b*.

Figure 8:
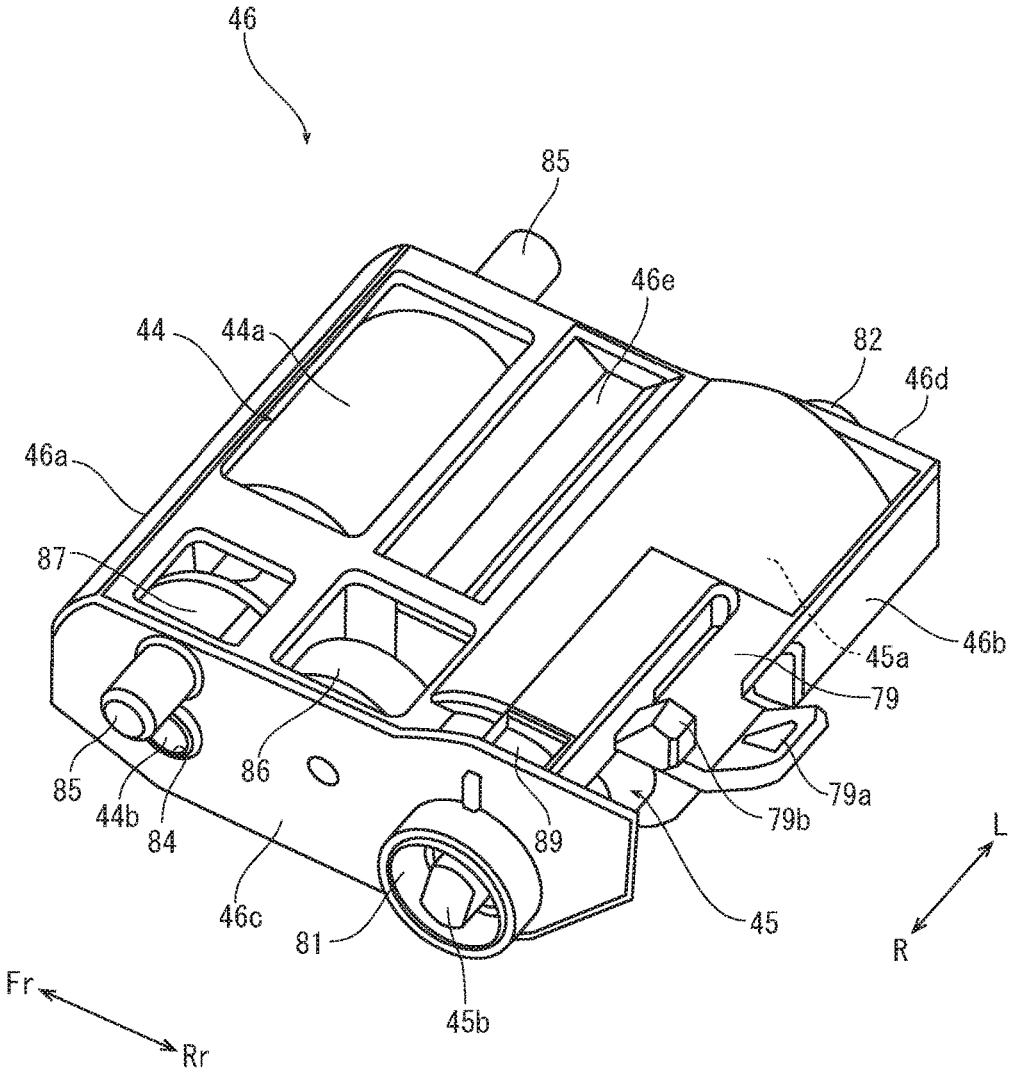
FIG. 8 is a perspective view showing a feed holder, in the sheet feeding device according to the embodiment of the present disclosure.

Next, with reference to FIG. 8, FIG. 9A and FIG. 9B, the feed holder 46 will be described. FIG. 8 is a perspective view showing the feed holder mounted to the upper mounting part, FIG. 9A is a perspective view showing a first supporting shaft of the feed holder and FIG. 9B is a perspective view showing a second supporting shaft of the feed holder.

As shown in FIG. 8, the feed holder 46 is a substantially parallelepiped box shaped member. The feed holder 46 has a front plate 46*a*, a rear plate 46*b*, a first side plate 46*c* and a second side plate 46*d* that are a pair of side plates formed parallel to the mounting and dismounting directions, and a top plate 46*e*. A bottom face of the feed holder 46 is opened. In a right halve of a corner between the top plate 46*e* and the rear plate 46*b*, a notch is formed. A lever 79 protrudes from the top plate 46*e* rightward in the notch. At the tip end portion of the lever 79, a press-down piece 79*a* protruding rearward and a locked protrusion 79*b* protruding upward are formed.

Figure 9A:
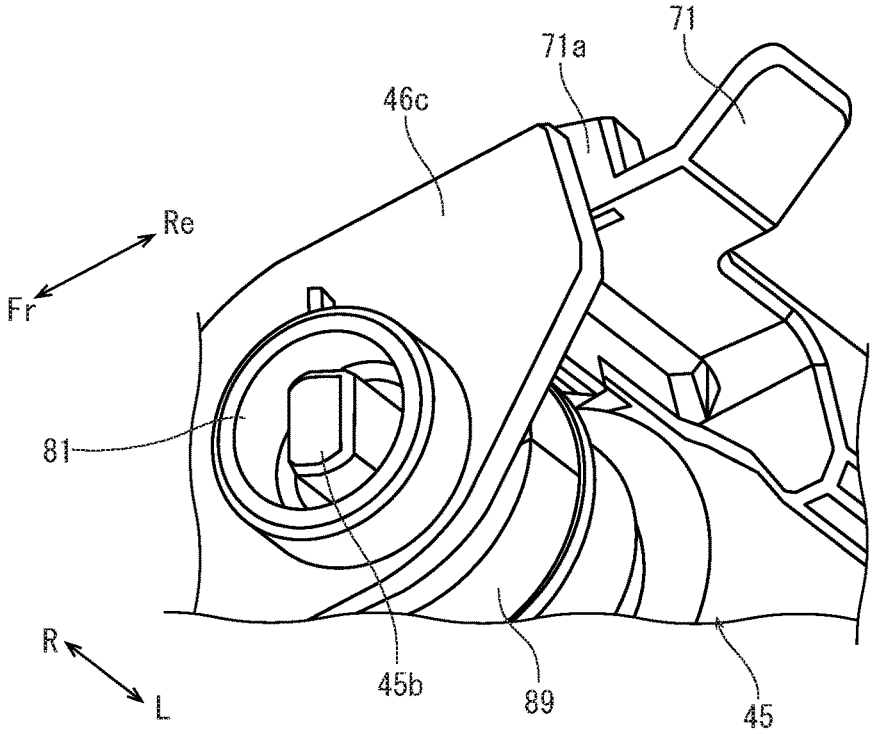
FIG. 9A is a perspective view showing a first supporting shaft of the feed holder, in the sheet feeding device according to the first embodiment of the present disclosure.

As shown in FIG. 9A, the first side plate 46*c* has a first supporting shaft 81 on the rear end portion (the end portion on the upstream side in the mounting direction). As shown in FIG. 9B, the second side plate 46*d* has a second supporting shaft 82 on the rear end portion (the end portion on the upstream side in the mounting direction). The first supporting shaft 81 and the second supporting shaft 82 are arranged on the same axis in the direction perpendicular to the mounting and dismounting directions. The first supporting shaft 81 and the second supporting shaft 82 each have a cylindrical shape which has an outer diameter capable of engaging into the first bearing part 57 and the second bearing part 58 (refer to FIGS. 4 and 5) formed in the first side wall 51*a* and the second side wall 51*b* of the upper mounting part 51 respectively.

Figure 9B:
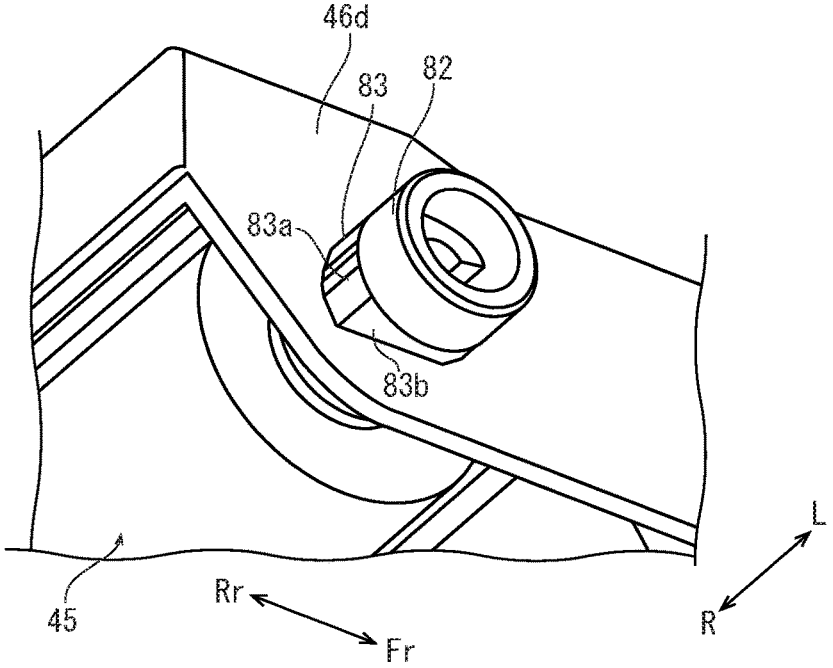
FIG. 9B is a perspective view showing a second supporting shaft of the feed holder, in the sheet feeding device according to the embodiment of the present disclosure.

As shown in FIG. 9B, at a proximal end portion of the second supporting shaft 82, a small diameter part 83 of an oval-shaped cross section is formed. The small diameter part 83 has a pair of curved side faces 83*a* and a pair of flat side faces 83*b*. The pair of curved side faces 83*a* curve in an arc shape along an outer circumference face of the second supporting shaft 82. The pair of flat side faces 83*b* are formed by cutting the second supporting shaft 82 at parallel planes to the axial direction of the second supporting shaft 82. The pair of curved side faces 83*a* has an outer diameter capable of being clearance-fitted into the second bearing part 58. A distance between the pair of flat side faces 83*b* is equal to a width of the notch 59 (refer to FIG. 5) of the second bearing part 58. In this manner, the small diameter part 83 is capable of passing through the notch 59.

As shown in FIG. 8, the first side plate 46*c* and the second side plate 46*d* each have a pickup roller bearing opening 84 to which the first rotating shaft 44*b* of the pickup roller 44 is to be rotatably supported on the front end portions (the end portions on the downstream side in the mounting direction). The pickup roller bearing openings 84 of the first side plate 46*c* and the second side plate 46*d* are arranged on the same axis in the direction perpendicular to the mounting and dismounting directions. In addition, above each of the pickup roller bearing opening 84, a guide shaft 85 protrudes from each of the first side plate 46*c* and the second side plate 46*d*. The guide shafts 85 protrude in the opposite directions each other in the direction perpendicular to the mounting and dismounting directions. That is, the guide shafts 85 protrudes in a direction parallel to the first rotating shaft 44*b*. As shown in FIG. 6, the guide shaft 85 is positioned above the pickup roller bearing opening 84 in a direction of a tangent line T passing through a center of the pickup roller bearing opening 84, out of tangent lines to a circle R centered on the first and second supporting shafts 81 and 82 and passes through the center of the pickup roller bearing opening 84.

Further, as shown in FIG. 8, on an inner face of the first side plate 46*c*, an idle gear 86 is rotatably supported between the pickup roller bearing opening 84 and the first supporting shaft 81.

The pickup roller 44 has a cylindrical roller main body 44*a* and a first rotating shaft 44*b*. At a portion slightly inside of an end on the one side (the right side) of the first rotating shaft 44*b*, a gear 87 which meshes with the idle gear 86 is fixed. The ends of the first rotating shaft 44*b* are rotatably supported in the pickup roller bearing openings 84 of the first side plate 46*c* and the second side plate 46*d*. The both ends of the first rotating shaft 44*b* slightly protrude from the first side plate 46*c* and the second side plate 46*d* through the pickup roller bearing openings 84. The protruded both ends of the first rotating shaft 44*b* are engaged with stopping members, such as C-rings, so that the first rotating shaft 44*b* is prevented from being removed. A protrusion length of the protruded both ends of the first rotating shaft 44*b* from the first side plate 46*c* and the second side plate 46*d* are shorter than a protrusion length of the guide shafts 85 from the first side plate 46*c* and the second side plate 46*d*.

The feed roller 45 has a cylindrical roller main body 45*a* and a second rotating shaft 45*b*. At a portion slightly inside of an end on the one side (the right side) of the second rotating shaft 45*b*, a gear 89 which meshes with the idle gear 86 is fixed. The ends of the second rotating shaft 45*b* penetrate through the first supporting shaft 81 and the second supporting shaft 82 so that the second rotating shaft 45*b* is aligned with the first and second supporting shafts 81 and 82. On a tip face of the one side (the right side) of the second rotating shaft 45*b*, an engagement protrusion 91 of an oval-shaped cross section is formed.

The retard holder 49 will be described with reference to FIG. 3. The retard holder 49 has a supporting part 49*a* to which the retard roller 48 is supported and a guide part 49*b* provided on the downstream side in the feeding direction of the supporting part 49*a*. A rear edge of the guiding part 49*b* curves in an upper rear oblique direction along the feeding direction to form the lower guide face of the main conveying path 33, as with the upper face of the lower supporting frame 42. The guiding part 49*b* has protrusions (not shown) which engage with the engagement depression 74 and the second groove 76 (refer to FIG. 7) formed in the lower mounting part 71 of the lower supporting frame 42. If the retard holder 49 is slid into the lower mounting part 71 from an upper rear oblique direction, the protrusions engage with the engagement depression 74 and the second groove 76.

The retard roller 48 is rotatably supported to a rotating shaft via a torque limiter. The retard roller 48 stops the rotation until a toque exceeding a predetermined torque is applied; while idles with respect to the rotating shaft if the torque exceeding to the predetermined toque is applied. Namely, if the torque exceeding the predetermined torque is applied, the retard roller 48 is driven by the pickup roller 44 to be rotated and to feed an uppermost sheet separated from another sheets.

The stopper 50 has a protrusion (not shown) which engages with the first groove 75 formed in the lower mounting part 71 of the lower supporting frame 42. If the stopper 50 is slid into the lower mounting part from the upper side, the protrusion engages with the first groove 75 and then is mounted to the lower mounting part 71. In this manner, the stopper 50 prevents the retard holder 49 from being removed. A detailed description of the retard holder 49 and the stopper 50 is omitted.

Figure 10:
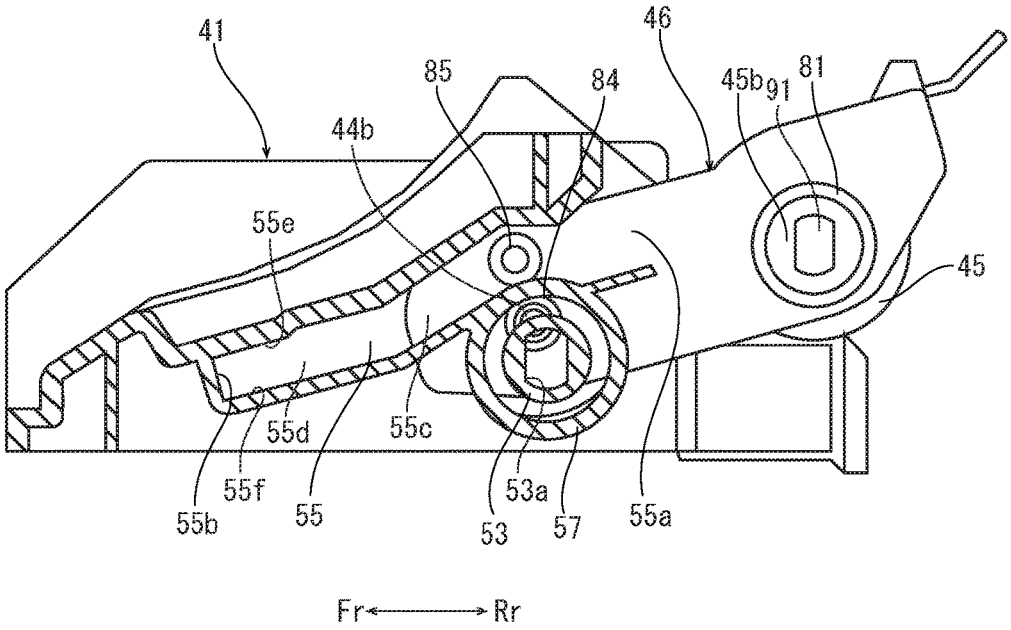
FIG. 10 is a sectional view showing a state where the guide shaft of the feed holder is engaged with the guide groove of the upper mounting part, in the sheet feeding device according to the first embodiment of the present disclosure.
Figure 11:
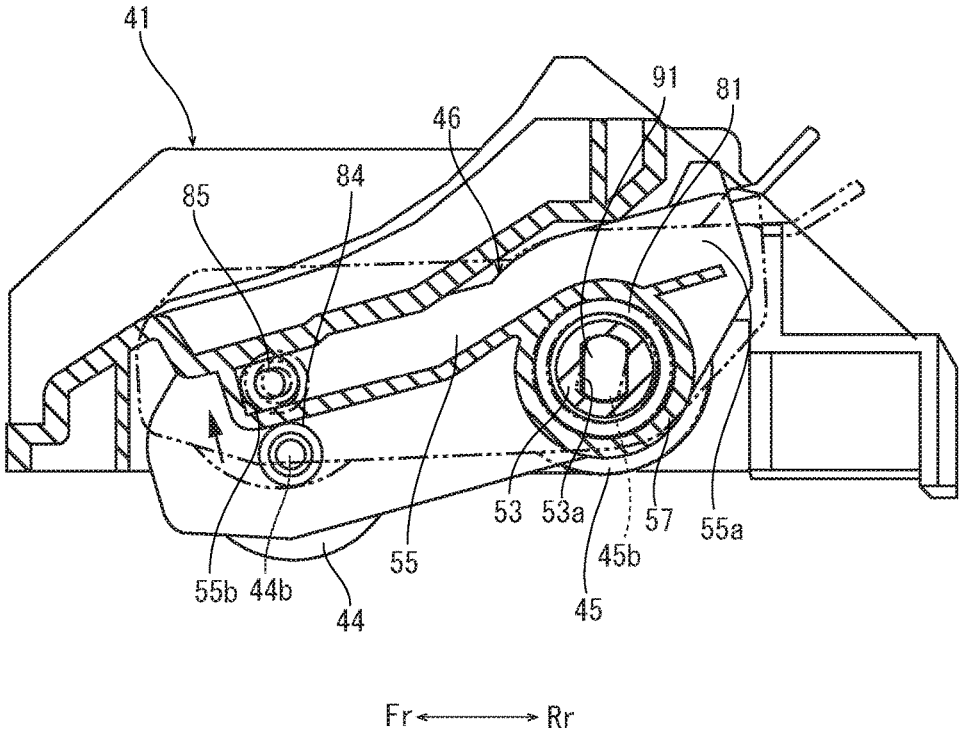
FIG. 11 is a sectional view showing a state where the guide shaft of the feed holder is slid along the guide groove of the upper mounting part, in the sheet feeding device according to the first embodiment of the present disclosure.
Figure 12:
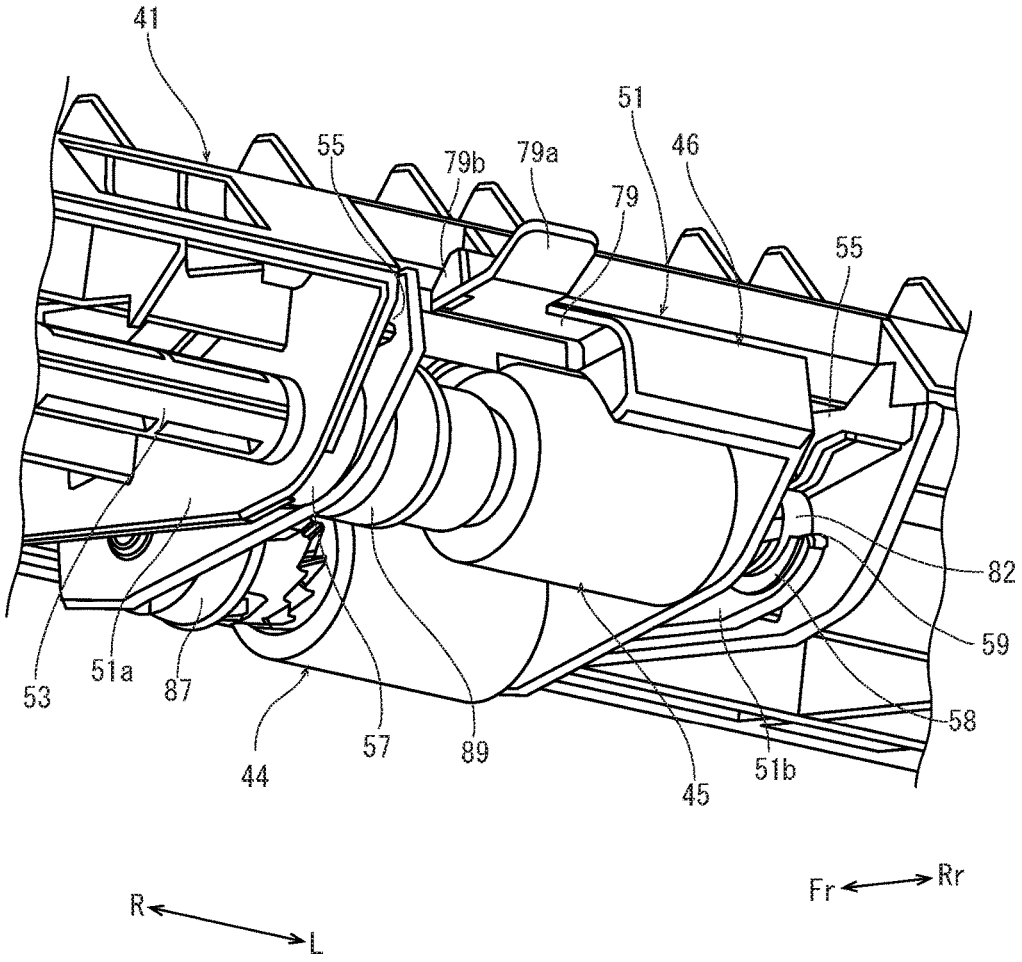
FIG. 12 is a sectional view showing the feed holder mounted to the upper mounting part, in the sheet feeding device according to the first embodiment of the present disclosure.

With reference to FIGS. 4 to 9B, FIGS. 10 to 12, a method of mounting the feed holder 46 to the upper mounting part 51 in the sheet feeding device 10 having the above construction will be described. FIG. 10 is a sectional view showing a state where the guide shaft is engaged with the guide groove, FIG. 11 is a sectional view showing a state where the guide shaft is slid along the guide groove and FIG. 12 is a sectional view showing the feed holder mounted to the upper mounting part.

First, the opening 2*a* of the apparatus main body 2 is opened by turning the rear cover 5 and the conveying unit 6 rearward. Then, the upper mounting part 51 and the lower mounting part 71 are exposed.

Afterwards, the feed holder 46 is mounted to the upper mounting part 51. First, as shown in FIG. 10, the guide shafts 85 are engaged with the guide grooves 55 from the opening ends 55*a* of the first side wall 51*a* and the second side wall 51*b*. At this time, although the both ends of the first rotating shaft 44*b* of the pickup roller 44 protrude from the pickup roller bearing openings 84, since the protrusion length of the first rotating shaft 44*b* is short, the both ends of the first rotating shaft 44*b* do not interfere with the first bearing part 57 and the second bearing part 58.

The guide shafts 85 are guided along the guide grooves 55 from the first inclined parts 55*c* to the second inclined parts 55*d*. The guide shafts 85 are slid on lower faces 55*f* of the second inclined part 55*d* with a small clearance formed between the guide shafts 85 and upper faces 55*e* of the second inclined parts 55*d*. When the guide shafts 85 are slid along the second inclined parts 55*d* until a position in front of the closed ends 55*b*, the small diameter part 83 (shown in FIG. 9B) of the second supporting shaft 82 gets into the second bearing part 58 through the notch 59 (as shown in FIG. 5). Then, one of the pair of curved side faces 83*a* comes into contact with the inner circumferential face of the second bearing part 58. In this manner, the sliding of the feed holder 46 is restricted. In addition, as shown in FIG. 11, the feed holder 46 is positioned at an aligning position where the second rotating shaft 45*b* of the feed roller 45 and the driving shaft 53 are arranged on the same axis. At this time, the guide shafts 85 do not come in contact with the closed ends 55*b* of the guide grooves 55.

With reference to FIG. 6, a positional relationship of the guide groove 55, the first rotating shaft 44*b* and the guide shaft 85 in a state where the feed holder 46 is mounted to the upper mounting part 51 will be described. The second inclined part 55*d* of the guide groove 55 inclines along a direction (shown by a line L1 in FIG. 6) perpendicular to a tangent line T at a center of the first rotating shaft 44*b* of a circle R (hereinafter, called as "a rotation locus R of the first rotating shaft 44*b*") passing through the center of the first rotating shaft 44*b* around the first and second bearing parts 57 and 58 (the centers C of the first and second supporting shafts 81 and 82). That is, the upper face 55*e* (contact face) and the lower face 55*f* of the second inclined part 55*d* are formed along the direction (L1) perpendicular to the tangent line T. When the feed holder 46 is mounted to the upper mounting part 51, the guide shaft 85 is positioned above the pickup roller bearing opening 84 along the tangent line T.

Next, the feed holder 46 is slid rightward while the lever 79 deformed elastically downward by pressing the press-down piece 79*a* (as shown in FIG. 8) downward. Then, the second supporting shaft 82 is fitted into the second bearing part 58. Since the outer diameter of the second supporting shaft 82 is larger than the width of the notch 59, the second supporting shaft 82 is prevented from coming off from the second bearing part 58. At the same time, the first supporting shaft 81 is fitted into the first bearing part 57 and the engagement protrusion 91 of the second rotating shaft 45*b* is engaged with the engagement hole 53*a* of the driving shaft 53. Then, the second rotating shaft 45*b* and the driving shaft 53 are coupled to each other so as to be rotatable together.

Afterwards, when the pressing of the press-down piece 79*a* downward is released, the locked protrusion 79*b* of the lever 79 is locked with the locking piece 62 and then the sliding of the feed holder 46 leftward is restricted. In this manner, as shown in FIG. 12, the feed holder 46 is mounted to the upper mounting part 51.

After the feed holder 46 is thus mounted to the upper mounting part 51, the retard holder 49 will be mounted to the lower mounting part 71. When the retard holder 49 is mounted to the lower mounting part 71, the protrusions of the guide part 49*b* engage with the engagement depression 74 and the second groove 76 (refer to FIG. 7). Also, the supporting part 49*a* is biased by a biasing member (not shown) in the clockwise direction of FIG. 3 and then the retard roller 48 is pressed against the feed roller 45.

Next, the stopper 50 is mounted to the lower mounting part 71 by engaging the protrusion with the first groove 75. In this manner, the movement of the retard holder 49 is restricted. Lastly, after turning the conveying unit 6, the rear cover 5 is turned to thereby close the opening 2*a*.

When the feed holder 46 and the retard holder 49 are mounted, the lift plate 9*a* is moved upward by the spring member 9*b* (refer to FIG. 1) of the sheet feeding cassette 9 and then the uppermost sheet S among the sheets stacked on the lift plate 9*a* is brought into pressure contact with the pickup roller 44 stored in the feed holder 46. In detail, as shown in FIG. 6, the pickup roller 44 is applied with upward pressing force F1 along the tangent line T at the center of the first rotating shaft 44*b* of the rotation locus R of the first rotating shaft 44*b*. In FIG. 6, the lift plate 9*a* is regarded as the sheet S for convenience.

When the pickup roller 44 is brought into contact with the sheet S and then the driving shaft 53 is driven, the second rotating shaft 45*b* of the feed roller 45 coupled to the driving shaft 53 is driven to be rotated. In addition, the pickup roller 44 is rotated in the same rotation direction as the feed roller 45 via the gear 89, the idle gear 86 and the gear 87. On rotating the pickup roller 44, the sheet S is fed rearward from the sheet feeding cassette 9 toward a space between the feed roller 45 and the retard roller 48.

In a case where only one sheet S is fed by the pickup roller 44, the sheet S is conveyed along the main conveying path 33 by the feed roller 45. On the other hand, in a case where two or more sheets S are fed by the pickup roller 44, the uppermost sheet is conveyed by the feed roller 45. However, since frictional force between the uppermost sheet S and a lower sheet is smaller than frictional force between the lower sheet and the retard roller 48 and thus a torque exceeding a predetermined torque is not applied to the retard roller 48, the retard roller 48 does not rotate and the lower sheet is therefore not conveyed. Thus, two or more sheets are appropriately separated and then only the uppermost S is conveyed on the downstream side.

The feed holder 46 is dismounted from the upper mounting part 51 in the reverse order to the above mounting order.

As described hereinabove, in the sheet feeding device 10 of the present disclosure, because the guide shaft 85 is formed on an axis different from an axis of the pickup roller bearing opening 84 which rotatably supports the first rotating shaft 44*b* of the pickup roller 44, a degree of freedom in design of a dye which is used for molding the feed holder 46 can increase.

Figure 13A:
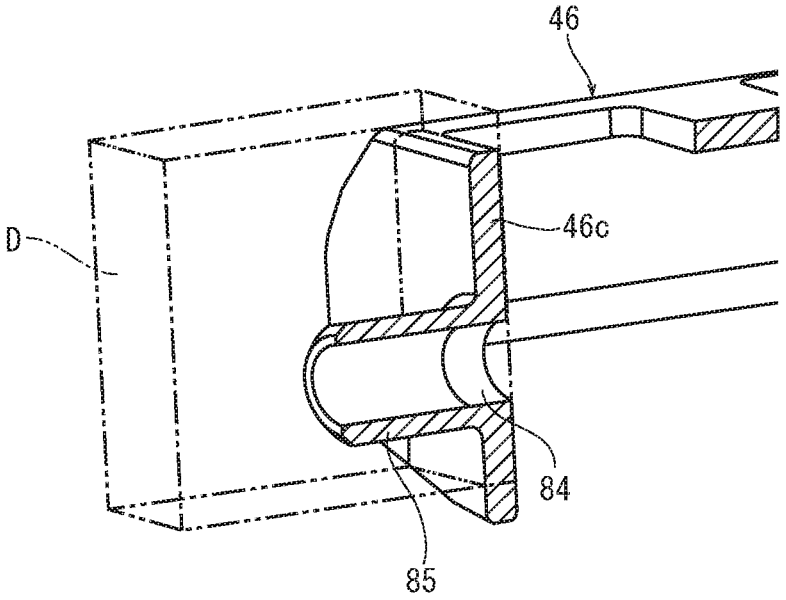
FIG. 13A is a sectional perspective view showing a dye which is used for molding the guide shaft of the feed holder, in a conventional sheet feeding device.
Figure 13B:
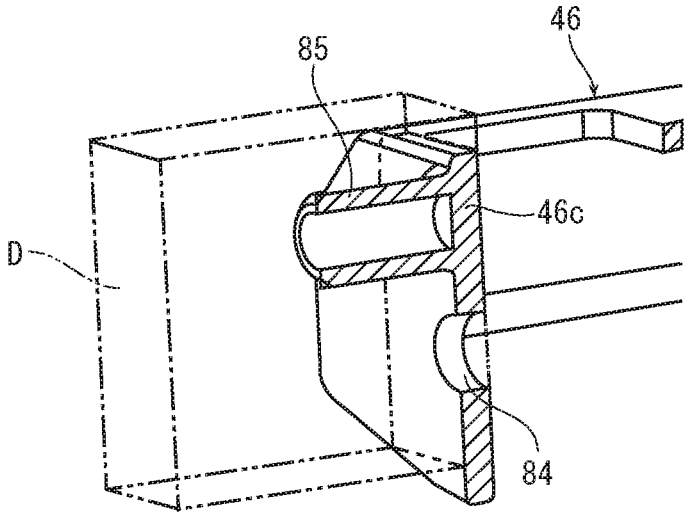
FIG. 13B is a sectional perspective view showing a dye which is used for molding the guide shaft of the feed holder, in the sheet feeding device according to the embodiment of the present disclosure.
Figure 14A:
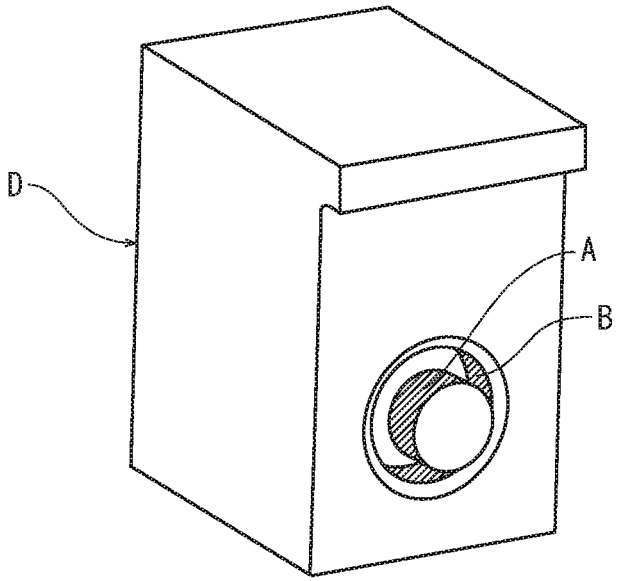
FIG. 14A is a perspective view showing the dye which is used for molding the guide shaft of the feed holder, in the conventional sheet feeding device.
Figure 14B:
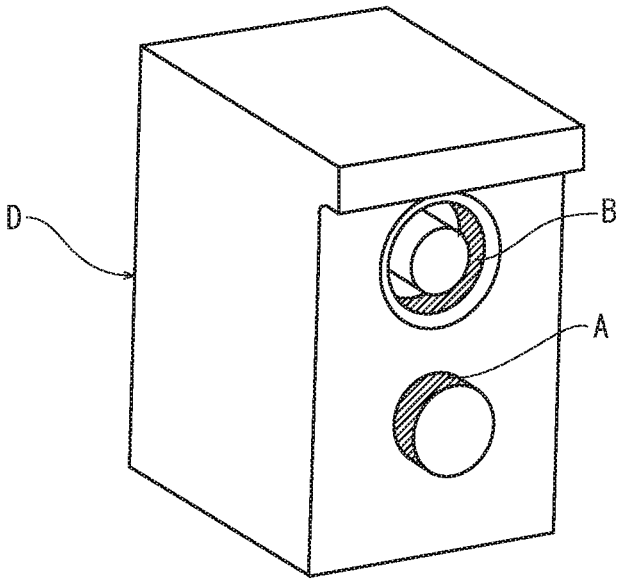
FIG. 14B is a perspective view showing the dye which is used for molding the guide shaft of the feed holder, in the sheet feeding device according to the embodiment of the present disclosure.

The reason will be described with reference to FIGS. 13A, 13B, 14A and 14B. FIGS. 13A and 13B are sectional side views showing the dyes. FIGS. 14A and 14B are perspective views showing the dyes. FIG. 13A and FIG. 14A show the dye used for molding the feed holder, as a comparative example. FIG. 13B and FIG. 14B show the dye used for molding the feed holder according to the embodiment. The comparative example shows a case where the guide shaft 85 is formed on the same axis as the first rotating shaft 44*b* of the pickup roller 44. In the comparative example, as shown in FIG. 13A and FIG. 14A, it is required to form a portion A which forms a circumference face of the pickup roller bearing opening 84 and a portion B which forms a circumference face of the guide shaft 85 on the same axis with high precision on the dye D. In addition, a cavity of the dye D has a depth which is a length obtained by adding a length of the guide shaft 85 to a depth of the pickup roller bearing opening 84 (a thickness of each of the first side plate 46*c* and the second side plate 46*d*).

On the other hand, in the present embodiment, as shown in FIG. 13B and FIG. 14B, it is possible to form the portion A which forms the circumference face of the pickup roller bearing opening 84 and the portion B which forms the circumference face of the guide shaft 85 separately on the dye D. In addition, one cavity to form the guide shaft 85 has a depth equal to the length of the guide shaft 85 and the other cavity has a depth equal to the depth of the pickup roller bearing opening 84. Therefore, compared with the comparative example, the depth of each cavity of the dye D can make to be shallower. Thus, a degree of freedom in design of the dye used for molding the feed holder 46 can increase.

Further, in the middle of the sliding of the guide shafts 85 along the guide grooves 55, the small diameter part 83 of the second supporting shaft 82 gets into the second bearing part 58 through the notch 59 and one of the pair of curved side faces 83*a* comes into contact with the inner circumferential face of the second bearing part 58. As a result, the feed holder 46 is positioned at the aligning position where the second rotating shaft 45*b* of the feed roller 45 and the driving shaft 53 are arranged on the same axis so that the feed holder 46 can be positioned easily.

Further, because the guide shafts 85 are formed above the pickup roller bearing openings 84, a lower portion below the guide shafts 85 of the feed holder 46 protrudes downward from the upper mounting part 51. In the other ward, at the mounting and dismounting of the feed holder 46, it is possible to narrow a space through which an upper portion above the guide shafts 85 of the feed holder 46 is passed.

That is, a highest moving locus of the feed holder 46 can be made to be lower so as not to interfere with the manual bypass conveying path 34.

For example, if the guide shafts 85 are formed on the same axis as the first rotating shaft 44*b* of the pickup roller 44, as shown in a two-dotted line in FIG. 11, the highest moving locus of the feed holder 46 may be made to be higher and thus interfere with the manual bypass conveying path 34. Then, in order to keep the moving space of the feed holder 46, it is necessary to increase sizes of the upper supporting frame 41 and the lower supporting frame 42. However, in the embodiment, the highest moving locus of the feed holder 46 can be made to be lower so that it is not necessary to increase the sizes of the upper and lower supporting frames 41 and 42.

Further, because the protruding length of the protruded the first rotating shaft 44*b* from the first and second side plate 46*c* and 46*d* is short, the protruded both ends of the first rotating shaft 44*b* do not interfere with the first bearing part 57 and the second bearing part 58. Accordingly, the mounting of the feed holder 46 to the mounting part 51 can be carried out easily.

Further, as shown in FIG. 6, the second inclined part 55*d* of the guide groove 55 is formed along the direction (L1) perpendicular to the tangent line T at the center of the first rotating shaft 44*b* on the moving locus R of the first rotating shaft 44*b*. That is, the upper face 55*e* and the lower face 55*f* of the second inclined part 55*d* are formed along the direction (L1) perpendicular to the tangent line T. In addition, the guide shaft 85 is positioned above the first rotating shaft 44*b* along the tangent line T.

Accordingly, when the pickup roller 44 is brought into pressure contact with the sheet S, the first rotating shaft 44*b* of the pickup roller 44 is applied with the upward pressing force F1 along the tangent line T. On the other hand, the guide shaft 85 abuts against the upper face 55*e* of the second inclined part 55*d* of the guide groove 55. The upper face 55*e* is formed along the direction (L1) perpendicular to the tangent line T so that the guide shaft 85 is applied with downward reverse force F2 along the tangent line T. Both of the pressing force F1 and the reverse force F2 are formed along the tangent line T so that unnecessary force (couple of force) is not produced. Accordingly, the pickup roller 44 can be brought into pressure contact with the sheet with suitable force.

Figure 15A:
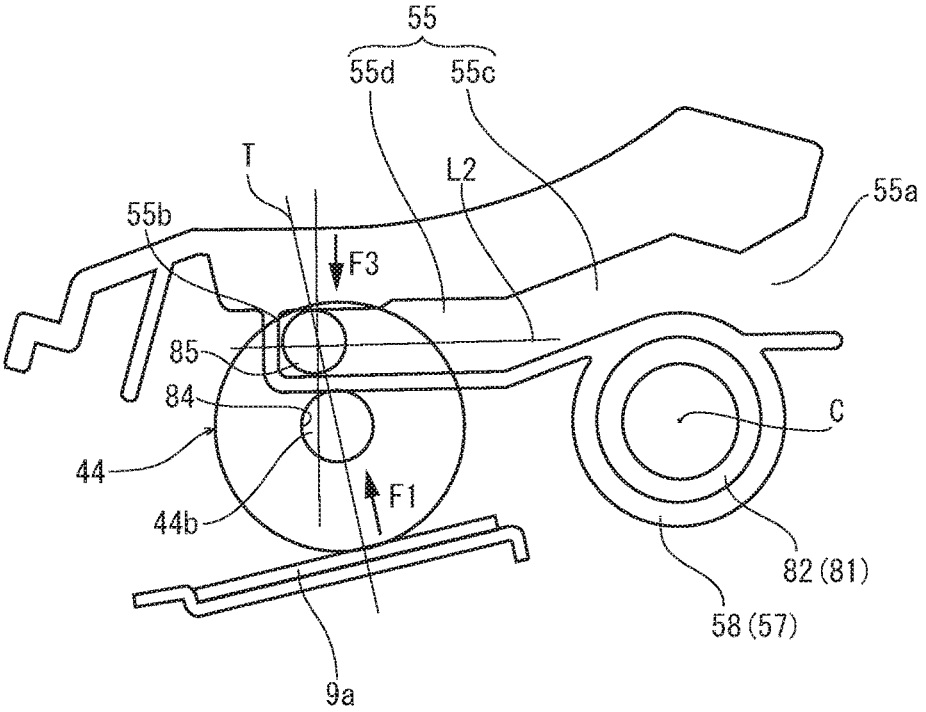
FIG. 15A is a side view showing a relationship of the guide groove, the pickup roller and the guide shaft in a condition where a direction of the guide groove is not perpendicular to a tangent line T, in the sheet feeding device according to the embodiment of the present disclosure.

As shown in FIG. 15A, if the second inclined part 55*d* of the guide groove 55 is not formed along the direction L1 (the direction of the second inclined part 55*d* is shown by L2) perpendicular to the tangent line T, a direction of the reaction force F3 applied on the guide shaft 85 is inclined relative to the direction of the pressing force F1 applying on the first rotating shaft 44*b* of the pickup roller 44 from the sheet S. In such a case, because slipping force in the inclined direction is generated, the pickup roller 44 is hardly brought in pressure contact with the sheet S with suitable force.

Figure 15B:
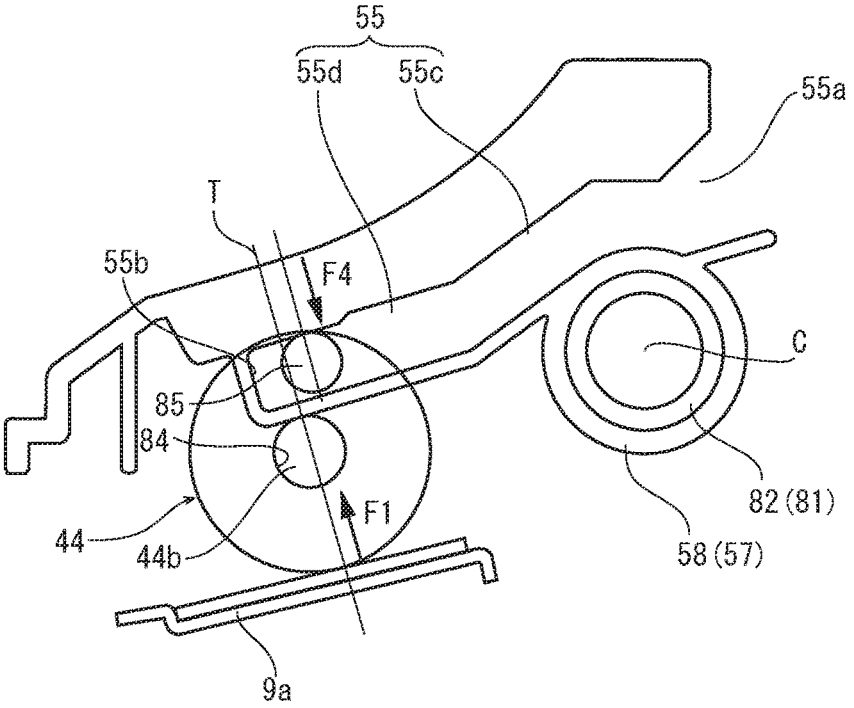
FIG. 15B is a side view showing a relationship of the guide groove, the pickup roller and the guide shaft in a condition where the guide shaft is offset from the tangent line T, in the sheet feeding device according to the embodiment of the present disclosure.

Alternatively, as shown in FIG. 15B, if the guide shaft 85 is offset from the tangent line T, the pressing force F1 and the reaction force F4 generate a couple of force, producing a bending moment. The bending moment may deform the feed holder 46. Or, the pickup roller 44 is not brought in pressure contact with the sheet S with suitable force and a feeding failure may occur.

While the preferable embodiment and its modified example of the sheet feeding device and the image forming apparatus of the present disclosure have been described above and various technically preferable configurations have been illustrated, a technical range of the disclosure is not to be restricted by the description and illustration of the embodiment. Further, the components in the embodiment of the disclosure may be suitably replaced with other components, or variously combined with the other components. The claims are not restricted by the description of the embodiment of the disclosure as mentioned above.

What is claimed is:

1. A sheet feeding device configured to feed a sheet stacked on a lift plate comprising:

a pickup roller configured to come in pressure contact with the sheet, to rotate around a first rotating shaft and then to feed the sheet;

a feed roller configured to rotate around a second rotating shaft and to convey the sheet fed by the pickup roller along a conveying path;

a feed holder having a pair of side plates formed parallel to a feeding direction of the sheet, the pair of side plates supporting the first rotating shaft and the second rotating shaft so as to extend in a direction perpendicular to the feeding direction; and a mounting part to which the feed holder is mounted and dismounted along mounting and dismounting directions parallel to the feeding direction, wherein the mounting part includes a pair of side walls facing each other in a direction perpendicular to the mounting and dismounting directions, and a pair of guide grooves formed on the pair of side walls along the mounting and dismounting directions, the feed holder includes a pair of guide shafts protruding from the pair of side plates in a direction parallel to the first rotating shaft, the pair of guide shafts being engaged with the pair of guide grooves and guided along the pair of guide grooves, wherein the pair of guide shafts are formed above the first rotating shaft.

2. The sheet feeding device according to claim 1, wherein the pair of side plates each have a bearing opening which rotatably supports an end portion of the first rotating shaft, and a protrusion length of each of the pair of guide shafts from each of the pair of side plates is longer than a protrusion length of the end portion of the first rotating shaft from each of the pair of side plates.

3. The sheet feeding device according to claim 1, wherein each of the pair of guide shafts slides on a lower face of each of the pair of guide grooves, and a clearance is formed between an upper face of each of the pair of guide grooves and each of the pair of guide shafts.

4. An image forming apparatus comprising:

the sheet feeding device according to claim 1 and an image forming part which forms an image on a sheet fed by the sheet feeding device.

5. A sheet feeding device configured to feed a sheet stacked on a lift plate comprising:

a pickup roller configured to come in pressure contact with the sheet, to rotate around a first rotating shaft and then to feed the sheet;

a feed roller configured to rotate around a second rotating shaft and to convey the sheet fed by the pickup roller along a conveying path;

a feed holder having a pair of side plates formed parallel to a feeding direction of the sheet, the pair of side plates supporting the first rotating shaft and the second rotating shaft so as to extend in a direction perpendicular to the feeding direction; and a mounting part to which the feed holder is mounted and dismounted along mounting and dismounting directions parallel to the feeding direction, wherein the mounting part includes a pair of side walls facing each other in a direction perpendicular to the mounting and dismounting directions, and a pair of guide grooves formed on the pair of side walls along the mounting and dismounting directions, the feed holder includes a pair of guide shafts protruding from the pair of side plates in a direction parallel to the first rotating shaft, the pair of guide shafts being engaged with the pair of guide grooves and guided along the pair of guide grooves, wherein the pair of guide shafts are formed above the first rotating shaft, wherein the feed holder has a pair of supporting shafts protruding from the pair of side plates on an upstream side of the pair of guide shafts in the mounting direction, and the mounting part has a pair of bearing parts which support the pair of supporting shafts of the pair of side plates.

6. The sheet feeding device according to claim 5, wherein the pair of guide shafts are formed above the first rotating shaft in a direction of a tangent line to a circle centered on the pair of supporting shafts and passing through a center of the first rotating shaft, the tangent line passing through the center of the first rotating shaft.

7. The sheet feeding device according to claim 6, wherein each of the pair of guide grooves has a contact face with which each of the pair of guide shafts comes in contact when the sheet comes in pressure contact with the pickup roller by moving the lift plate upward and the pickup roller is pressed upward by the sheet, and wherein each of the contact faces is formed along a direction perpendicular to the tangent line.

8. The sheet feeding device according to claim 5 comprising:

a supporting frame on which the mounting part is formed, and a driving shaft supported on the supporting frame, wherein the second rotating shaft is configured to couple to the driving shaft to be rotated and is formed on the same axis lines as the pair of supporting shafts.

9. An image forming apparatus comprising:

a sheet storage part in which a sheet is stored;

a lift plate provided in the sheet storage part movable upward and downward, the sheet being stacked on the lift plate;

a pickup roller configured to come in pressure contact with the sheet, to rotate around a first rotating shaft and then to feed the sheet;

a feed roller configured to rotate around a second rotating shaft and to convey the sheet fed by the pickup roller along a conveying path;

a feed holder which supports the first rotating shaft and the second rotating shaft; and a mounting part to which the feed holder is mounted and dismounted along mounting and dismounting directions parallel to a feeding direction of the sheet, wherein the feed holder includes a pair of side plates formed parallel to the mounting and dismounting directions and supporting the first rotating shaft and the second rotating shaft so as to extend in a direction perpendicular to the mounting and dismounting directions;

a pair of guide shafts protruding from the pair of side plates along an axis line different from an axis line of the first rotating shaft; and a pair of supporting shafts protruding from the pair of side plates on an upstream side of the pair of guide shafts in the mounting direction, the mounting part includes a pair of side walls facing each other in a direction perpendicular to the mounting and dismounting directions;

a pair of guide grooves formed on the pair of side walls along the mounting and dismounting directions so that the pair of guide shafts are engaged with and guided along the pair of guide grooves; and a pair of bearing parts which support the pair of supporting shafts at a predetermined position, wherein the pair of guide shafts are formed above the first rotating shaft in a direction of a tangent line to a circle centered on the pair of supporting shafts and passing through the center of the first rotating shaft, the tangent line passing through the center of the first rotating shaft, and each of the pair of guide grooves has a contact face with which each of the pair of guide shafts comes in pressure contact when the sheet comes in pressure contact with the pickup roller and the pickup roller is pressed upward by the sheet, the contact face is formed along a direction perpendicular to the tangent line.

* * * * *